US007399161B2

(12) United States Patent
Kao et al.

(10) Patent No.: US 7,399,161 B2
(45) Date of Patent: Jul. 15, 2008

(54) CENTRIFUGAL FAN

(75) Inventors: Yu-Chien Kao, Taoyuan County (TW); Tsu-Liang Lin, Taoyuan County (TW); Kuo-Cheng Lin, Taoyuan County (TW); Wen-Shi Huang, Taoyuan County (TW)

(73) Assignee: Delta Electronics, Inc., Taoyuan County (TW)

( * ) Notice: Subject to any disclaimer, the term of this patent is extended or adjusted under 35 U.S.C. 154(b) by 153 days.

(21) Appl. No.: 10/963,621

(22) Filed: Oct. 14, 2004

(65) Prior Publication Data

US 2005/0095132 A1 May 5, 2005

(30) Foreign Application Priority Data

Nov. 4, 2003 (TW) ..... 92130681 A

(51) Int. Cl.
*F01D 5/22* (2006.01)

(52) U.S. Cl. ..... 416/187

(58) Field of Classification Search ..... 416/182–185, 416/186 R, 178, 187, 188, 223 B, 228, 235, 416/237, 238; 417/366, 368
See application file for complete search history.

(56) References Cited

U.S. PATENT DOCUMENTS

| | | | | | |
|---|---|---|---|---|---|
| 1,015,274 | A * | 1/1912 | Keith | 416/186 R |
| 1,075,120 | A * | 10/1913 | Rogers | 416/188 |
| 1,181,780 | A * | 5/1916 | Loewenstein | 416/186 R |
| 1,243,615 | A * | 10/1917 | Liggett | 416/186 R |
| 1,700,017 | A * | 1/1929 | Bender | 416/187 |
| 2,870,959 | A * | 1/1959 | Giddings | 416/188 |
| 3,692,428 | A * | 9/1972 | Bubb et al. | 416/187 |
| 3,846,043 | A * | 11/1974 | Wolbrink et al. | 416/183 |
| 5,813,831 | A | 9/1998 | Matsunaga et al. | |
| 6,474,936 | B1 | 11/2002 | deBlanc et al. | |
| 6,514,052 | B2 * | 2/2003 | Bostwick | 417/366 |
| 6,568,907 | B2 * | 5/2003 | Horng et al. | 416/185 |
| 6,929,452 | B1 * | 8/2005 | Pargeter et al. | 416/186 R |
| 6,942,459 | B2 * | 9/2005 | Li et al. | 416/178 |
| 2002/0176787 | A1 * | 11/2002 | Cifarelli | 417/366 |
| 2003/0044280 | A1 * | 3/2003 | Kim et al. | 416/186 R |
| 2003/0077174 | A1 * | 4/2003 | Kim | 416/186 R |
| 2004/0258527 | A1 * | 12/2004 | Kaneko et al. | 416/182 |
| 2005/0287003 | A1 * | 12/2005 | Horng et al. | 416/187 |

FOREIGN PATENT DOCUMENTS

| | | | | |
|---|---|---|---|---|
| CN | 2560780 Y | | 7/2003 | |
| DE | 1063323 A | * | 8/1959 | 416/186 R |
| JP | 54-101506 A | * | 8/1979 | 416/187 |

* cited by examiner

*Primary Examiner*—Edward K. Look
*Assistant Examiner*—Devin Hanan
(74) *Attorney, Agent, or Firm*—Muncy, Geissler, Olds & Lowe, PLLC

(57) ABSTRACT

A centrifugal fan includes a hub and an impeller. The impeller is composed of a plurality of blades mounted around an outer circumference of the hub. The paraxial side of the blade forms a backward leaning structure, while the non-paraxial side thereof forms a forward leaning structure. A chamfer structure also can be formed at a paraxial side of each blade to enlarge the air inlet of the fan. Each blade further includes a protrusion, which is located at a side opposite to the inlet and extends toward a center of the hub, to increase the airflow rate through the fan motor. The centrifugal fan further includes an anti-decompression cap connected to an inlet side of the impeller to prevent an axial flow of the intake air from decompression.

17 Claims, 4 Drawing Sheets

CENTRIFUGAL FAN

BACKGROUND OF THE INVENTION

This Non-provisional application claims priority under 35 U.S.C. § 119(a) on Patent Application No(s). 092130681 filed in Taiwan, Republic of China on Nov. 4, 2003, the entire contents of which are hereby incorporated by reference.

1. Field of the Invention

The invention relates to a fan, and more particularly to a centrifugal fan.

2. Description of the Related Art

A conventional centrifugal fan, as disclosed in U.S. Pat. No. 5,813,831, is mainly composed of a hub (not shown) and a plurality of blades 11, as shown in FIGS. 1*a* and 1*b*. The hub secures the fan and enables the fan to rotate about a rotation shaft (not shown). Each blade 11 has a paraxial end mounted to an outer circumference of the hub. The blades may be divided into forward leaning blades (FIG. 1*a*) and backward leaning blades (FIG. 1*b*) in terms of their arrangement manners.

However, the above-mentioned centrifugal fan still has several drawbacks to be improved. For example, under the same rotating speeds of the fans, the fan with the forward leaning blades may output larger wind pressure and provide a better heat dissipating effect but larger loading than the fan with the backward leaning blades. Therefore, it is difficult to increase the rotating speed of the fans with the forward leaning blades. On the other hand, under the same rotating speeds of the fans, the fans with the backward leaning blades have poorer heat dissipating effect than those with the forward leaning blades and thus the rotating speeds of the fans with backward leaning blades have to be increased in order to provide the same heat dissipating effect as those with the forward leaning blades. However, the noise produced is correspondingly increased owing to the increase of the rotating speed.

Furthermore, the air passage is formed by enclosing the fan blades and the fan's outer frame and predetermined gaps exist between the fan blades and the fan's outer frame. If the gaps are too small, the blades tend to be damaged by colliding with the fan's outer frame owing to the factors such as vibration. If the gaps are too large, the sucked air may flow axially and thus cause the decompression condition such that the heat dissipating effect is deteriorated and the noise is amplified.

Also, the conventional centrifugal fan often has a reduced inlet area in order to enlarge the working area of the blade. That is, the widths at two sides of the blades are the same. Therefore, the heat dissipating effect is naturally and relatively deteriorated when the intake air quantity is reduced.

In addition, the conventional fan design is only focused on the system's heat dissipation. Nevertheless, the high temperature produced by the high speed operation of the fan motor is ignored. Hence, the fan motor tends to shut down owing to high temperature or self-protection.

In summary, it is an important objective of the invention to overcome the above-mentioned problems of the centrifugal fan.

SUMMARY OF THE INVENTION

In view of the above-mentioned problems, an object of the invention is to provide a centrifugal fan capable of integrating the advantages of the forward leaning blades and the backward leaning blades and thus to improve the heat dissipating effect of the centrifugal fan.

Another object of the invention is to provide a centrifugal fan capable of improving the decompression condition during the fan's operation so as to enhance the heat dissipating effect and reduce the noise.

Still another object of the invention is to provide a centrifugal fan with an enlarged fan inlet for keeping the main working area of the blades and enhancing the heat dissipating effect.

Yet still another object of the invention is to provide a centrifugal fan capable of dissipating heat from its motor when the fan is operating.

To achieve the above-mentioned objects, the invention provides a centrifugal fan comprising a hub, a connecting portion and an impeller. The hub is for securing the centrifugal fan to a rotation shaft that rotates to drive the impeller. The connecting portion is formed by outwardly and radially extending from an outer circumference of the hub. The impeller comprises a plurality of blades, and the paraxial sides of the blades are mounted around the connecting portion to fix to the outer circumference of the hub.

In a first embodiment, the paraxial sides of the blades are formed to have the backward leaning structures, and the non-paraxial sides of the blades are formed to have the forward leaning structures. According to this structure, the interval between the non-paraxial sides of two blades is larger than an interval between the paraxial sides of the two blades.

In a second embodiment, the centrifugal fan further includes an anti-decompression cap having a ring-shaped structure connected to an inlet side of the impeller, and an inner diameter of the anti-decompression cap is greater than, equal to, or smaller than a diameter of the impeller at the inlet side.

In a third embodiment, a radial width of each of the blades at the inlet side is relatively smaller than that at an lee side, such that the blade forms a chamfer structure at the paraxial side. The chamfer structure may be a curved chamfer structure or a linear chamfer structure, and an axial height of the paraxial side of each of the blades is relatively smaller than that of the non-paraxial side.

In a fourth embodiment, each of the blades includes a protrusion extending toward a center of the hub at a lee side. An intensification ring, which connects to an outer edges of the blades, is also included.

It is to be noted that the above-mentioned embodiments may be independently or dependently implemented. For example, the features of the embodiments may be implemented in the same centrifugal fan.

According to the centrifugal fan of the invention, the advantages of the forward leaning blades and the backward leaning blades may be obtained because the paraxial sides of the blades have the backward leaning structures and the non-paraxial sides of the blades have the forward leaning structures. The anti-decompression cap may prevent the air entering the passage from flowing axially. Thus, the decompression condition during the fan operation can be improved, the heat dissipating effect can be enhanced, and the noise can be reduced. In addition, the chamfer structure of the blade enlarges the inlet of the impeller, and is advantageous to the air suction as well as the keeping of the main working area of the blade, thereby increasing the heat dissipating effect. Also, the protrusion structure of the blade can increase the airflow rate through the fan motor. When the fan is operating, it is possible to enhance the heat dissipation of the motor itself. Both of the intensification ring and the anti-decompression cap can intensify the blade structure so that the blades can be made thinner.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE INVENTION

The centrifugal fans according to the preferred embodiments of the invention will be described with reference to the accompanying drawings.

Figure 1A:
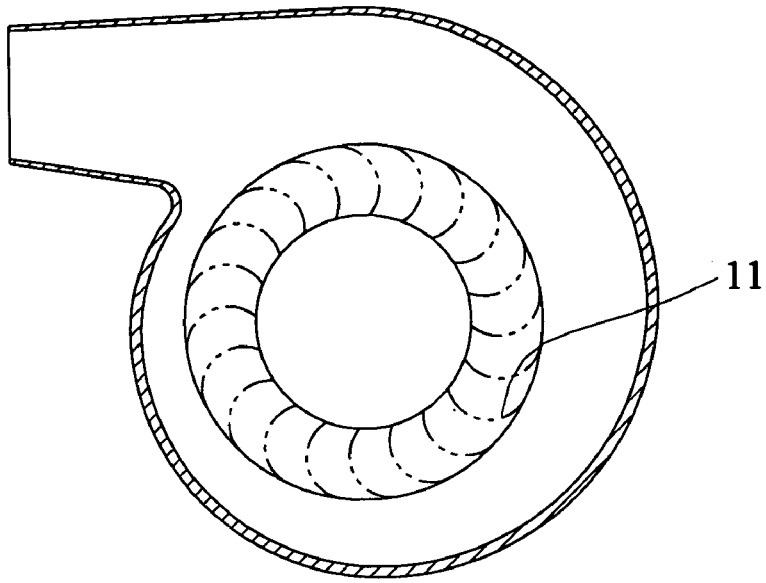
FIG. 1a (Prior Art)
FIG. 1*a* is a top view showing a conventional fan with forward leaning blades.
Figure 1B:
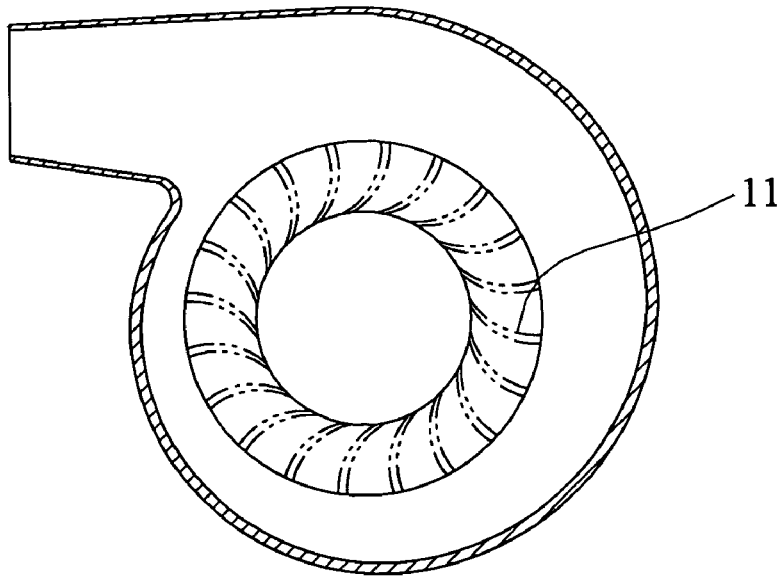
FIG. 1b (Prior Art)
FIG. 1*b* is a top view showing a conventional fan with backward leaning blades.
Figure 2:
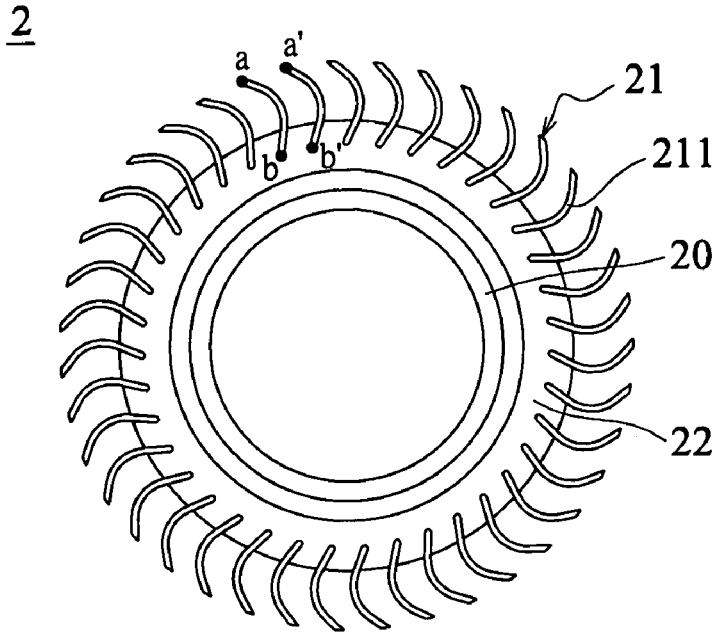
FIG. 2 is a top view showing a centrifugal fan according to a first embodiment of the invention.

Referring to FIG. 2, a centrifugal fan 2 according to a first embodiment of the invention includes a hub 20 and an impeller 21. The hub 20 is for securing the centrifugal fan 2 to a rotation shaft, which rotates to drive the fan. The impeller 21 is composed of a plurality of blades 211, each of which has a paraxial side and a non-paraxial side. The paraxial sides of the blades 211 are mounted around the outer circumference of the hub 20. The paraxial sides of the blades 211 are formed to have the backward leaning structures, and the non-paraxial sides of the blades 211 are formed to have the forward leaning structures. As shown in FIG. 2, each blade 211 of the impeller 21 in the top view has a spoon-like shape. According to this structure, an interval aa' between the non-paraxial ends of the blades 211 is made relatively larger than an interval bb' between the paraxial ends of the blades 211.

Figure 3:
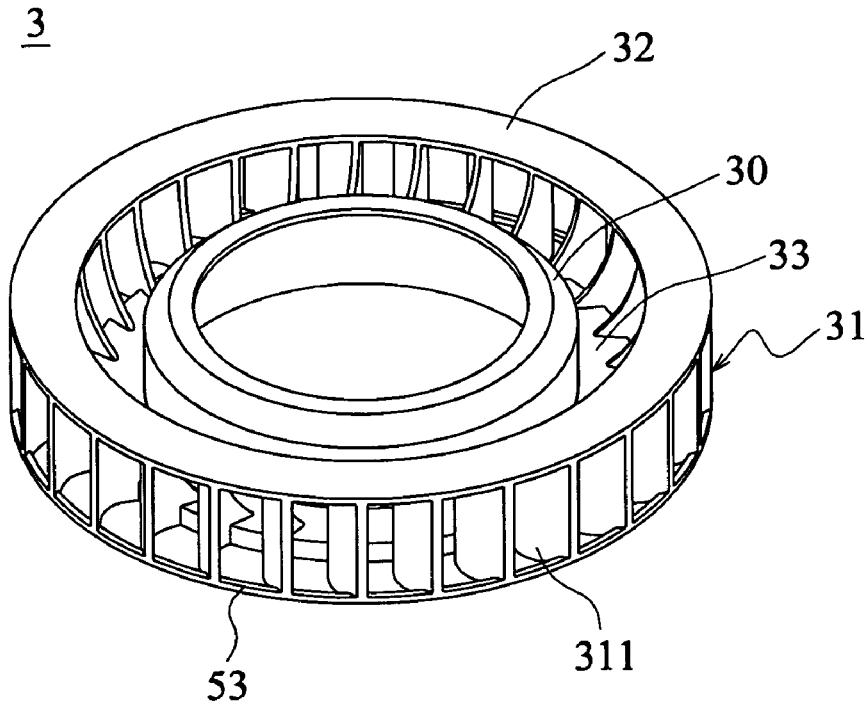
FIG. 3 is a pictorial view showing a centrifugal fan according to a second embodiment of the invention.

Referring to FIG. 3, a centrifugal fan 3 according to a second embodiment of the invention includes a hub 30, an impeller 31 and an anti-decompression cap 32. The hub 30 is for securing the centrifugal fan 3 to a rotation shaft, which rotates to drive the fan. The impeller 31 is composed of a plurality of blades 311, each of which has a paraxial side and a non-paraxial side. The paraxial sides of the blades 311 are mounted around the outer circumference of the hub 30. The anti-decompression cap 32 has a ring-shaped structure connected to an inlet side of the impeller 31. The inner diameter of the anti-decompression cap 32 may be greater than, equal to or smaller than the diameter of the inlet of the impeller 31. The dimension of the inlet equals the region formed by the lines for connecting the paraxial ends of the blades 311 at the inlet side. The outer diameter of the anti-decompression cap 32 is greater than, equal to, or smaller than the outer diameter of the impeller 31. For example, the outer diameter of the impeller 31 equals that of a region formed by the lines for connecting the non-paraxial ends of the blades 311 at the inlet side. It is to be noted that the inner diameter of the anti-decompression cap 32 is preferably greater than or equal to the inlet diameter to increase the effective intake airflow area of the inlet.

Figure 4A:
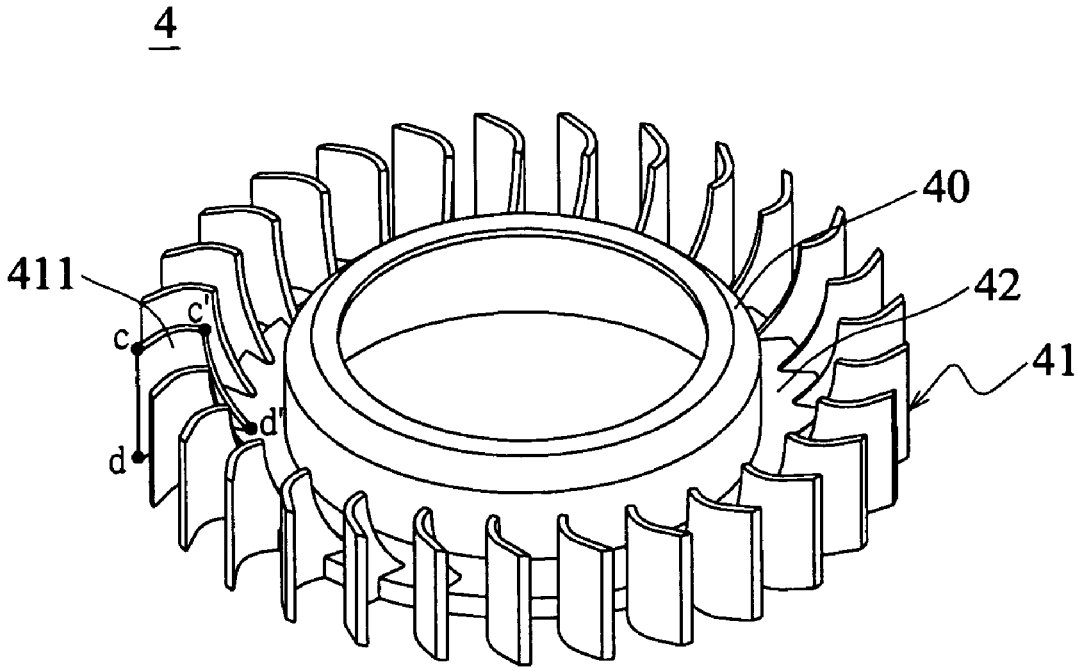
FIG. 4*a* is a pictorial view showing a centrifugal fan according to a third embodiment of the invention.
Figure 4B:
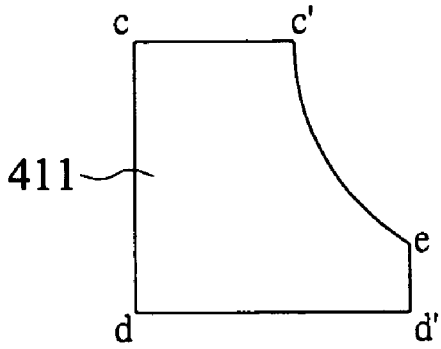
FIG. 4*b* shows a curved chamfer structure of a single blade according to the third embodiment of the invention.
Figure 4C:
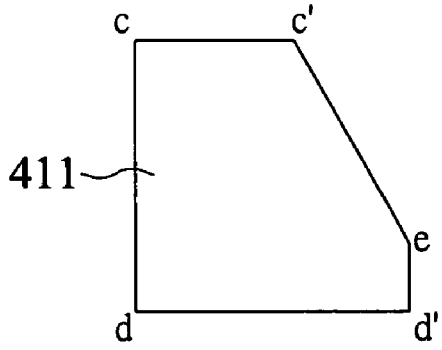
FIG. 4*c* shows a linear chamfer structure of the single blade according to the third embodiment of the invention.

Referring to FIG. 4*a*, a centrifugal fan 4 according to a third embodiment of the invention includes a hub 40 and an impeller 41. The hub 40 is for securing the centrifugal fan 4 to a rotation shaft, which rotates to drive the fan. The impeller 41 is composed of a plurality of blades 411, each of which has a paraxial side and a non-paraxial side. The paraxial sides of the blades are mounted around the outer circumference of the hub 40. The radial width cc' at the inlet side of the blade 411 is relatively smaller than the radial width dd' at the lee side such that the blade 411 forms a chamfer structure at the paraxial side. The lee side is opposite to the inlet side. The chamfer structure may be an arced chamfer, curved chamfer (as shown in FIG. 4*b*) or a linear chamfer (as shown in FIG. 4*c*). Also, the axial height ed' at the paraxial side of the blade 411 may be adjusted so that the working area of the blades may be properly enlarged or reduced. The axial height ed' at the paraxial side of the blade 411 preferably is between 0 and the axial height cd at the non-paraxial side of the blade 411. However, the axial height ed' at the paraxial side of the blade 411 can be greater than the axial height cd at the non-paraxial side of the blade 411.

Figure 5:
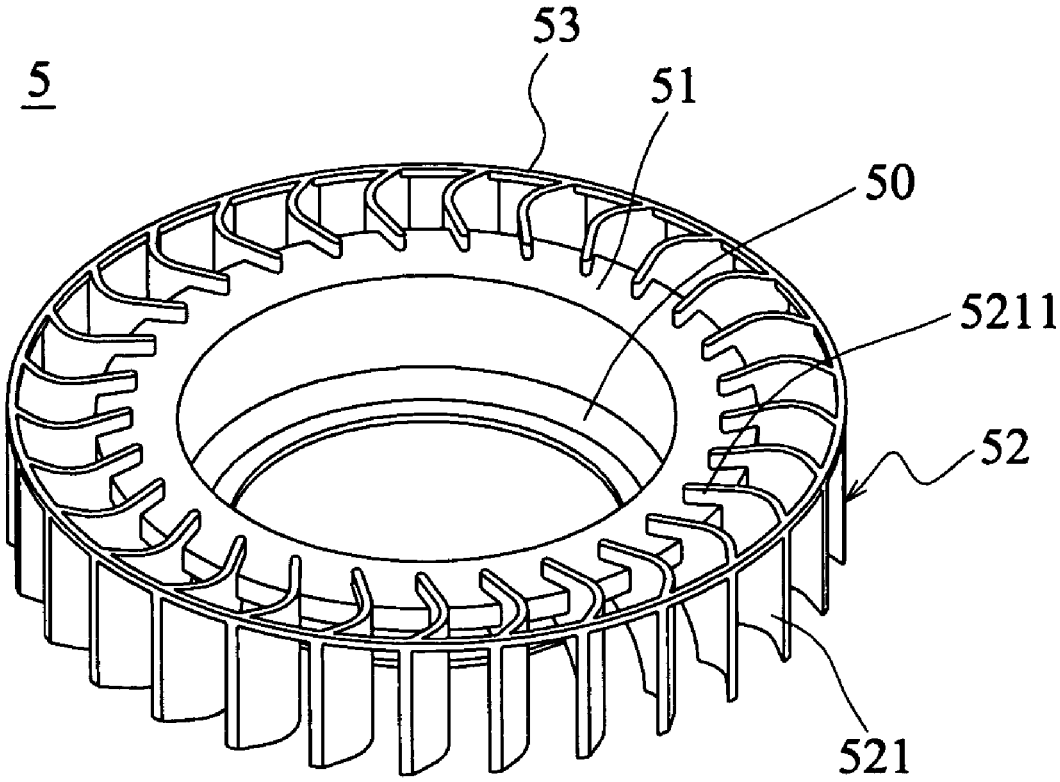
FIG. 5 is a pictorial view showing a centrifugal fan according to a fourth embodiment of the invention.

Referring to FIG. 5, a centrifugal fan 5 according to a fourth embodiment of the invention includes a hub 50, a connecting portion 51 and an impeller 52. The hub 50 is for securing the centrifugal fan 5 to a rotation shaft, which rotates to drive the fan. The connecting portion 51 is formed by radially and outwardly extending from the outer circumference of the hub 50. The impeller 52 is composed of a plurality of blades 521, each of which has a paraxial side and a non-paraxial side. The paraxial sides of the blades 521 are fixed to the connecting portion 51 to fix to the outer circumference of the hub 50. The connecting portion 51 and the hub 50 may be integrally formed as a single piece. Each of the blades 521 has an protrusion 5211 on lee sides of the blades 521, the protrusion 5211 is protruding out of the lee side of the connecting portion 51 and extends toward a center of said hub. Referring to FIG. 5, the fourth embodiment of the invention further includes at least one intensification ring 53 connected to the outer edges of the blades 521. For example, the intensification ring 53 may be connected to the inlet sides, the lee sides or other position of the non-paraxial sides of the blades 521.

In summary, because the centrifugal fan of the invention has the paraxial sides of the blades 211 with the backward leaning structures, the loading of the fan motor can be reduced. Also, because the non-paraxial sides of the blades 211 have the forward leaning structures, it is possible to improve the poor heat dissipating effect of the fan with the backward leaning blades. Meanwhile, according to the structure of the first embodiment, the interval aa' between the non-paraxial ends of the blades 211 is smaller than the interval bb' between the paraxial ends, so that the air is compressed when it passes through the air passage, and the greater wind pressure can be produced to enhance the heat dissipating effect.

In the centrifugal fan of the invention, because the air is restricted in the air passage, which is formed by enclosing the blades 311 and the anti-decompression cap 32, the air entering the passage cannot escape easily, and thus the decompression condition can be improved so as to output the air with larger wind pressure, enhance the heat dissipating effect, and effectively reduce the noise. In addition, the anti-decompression cap 32 can also intensify the structure of the blade 311 so that the blade 311 can be made thinner to provide a larger air passage for the airflow.

In addition, because the width of the blade 411 of the centrifugal fan of the invention at the inlet side is relatively smaller, there is a larger inlet for sucking a greater amount of air when the blades 411 are rotated. Because the widths of the blades at the lee sides of the inlet sides are made larger to keep the adequate working area of the blades, most of the working area of the blades will not be lost due to the enlargement of the inlet.

Furthermore, in order to enable the centrifugal fan of the invention to reduce the accumulated heat during the operation of the fan motor, openings may be formed on the hub 50 or the connection iron housing between the hub 50 and the rotation shaft. The airflow rate through the fan motor can be increased according to the structures of the protrusions 5211 of the blades 521. Therefore, a great amount of thermal energy, which is generated when the fan motor is operating, can be dissipated, the temperature of the fan motor can be effectively decreased, and the fan motor can operate at high speed for a long period of time so that the heat dissipating efficiency can be enhanced.

Furthermore, the intensification ring 53 can also intensify the structures of the blades 521, and the blades 521 can be made thinner accordingly.

It is to be noted that although the technological features of the above-mentioned embodiments are independently illustrated, one of ordinary skill in the art may implement a modified embodiment by combining at least two of the features. For instance, although the paraxial side of the blade of the first embodiment has the backward leaning structure and the non-paraxial side of the blade has the forward leaning structure, one of ordinary skill in the art may further combine the feature with the second embodiment. That is, an anti-decompression cap is attached to the inlet side of the blade of the first embodiment in order to prevent the condition of decompression. Also, as shown in FIG. 3, in addition to the anti-decompression cap 32, the centrifugal fan 3 may include the blade 311 with a chamfer structure, and an intensification ring 53 to intensify the blade structure. Furthermore, the structure of the connecting portion 51 may also be adapted to other embodiments except for the fourth embodiment, and corresponding connecting portions 22, 33 and 42 also may be provided in other embodiments. Therefore, the embodiments may be optionally combined according to the demands.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A centrifugal fan, comprising:

a hub;

an impeller comprising a plurality of blades, each of the blades, without directly contacting the hub, having a non-paraxial side and a paraxial side mounted around an outer circumference of said hub, wherein the paraxial sides of said blades are formed to have backward leaning structures, the non-paraxial sides of said blades are formed to have forward leaning structures, and each of the paraxial sides of said blades has a chamfer structure at an inlet side of the impeller; and a connecting portion outwardly and radially extending from the outer circumference of said hub, wherein the paraxial sides of said blades are fixed to said connecting portion in order to be fixed to said hub, the forward leaning structures are arranged apart from the connecting portion, and the chamfer structure is located apart from the connection portion at an axial height.

2. The centrifugal fan according to claim 1, wherein said connecting portion and said hub are integrally formed as a single piece.

3. The centrifugal fan according to claim 1, further comprising:

an anti-decompression cap having a ring-shaped structure connected to the inlet side of said impeller.

4. The centrifugal fan according to claim 3, wherein said anti-decompression cap has an inner diameter greater than or equal to a diameter at the inlet side of said impeller.

5. The centrifugal fan according to claim 1, wherein a radial width of each of said blades at the inlet side of the impeller is relatively smaller than that at a lee side of the impeller.

6. The centrifugal fan according to claim 1, wherein said chamfer structure of each of said blades is a curved chamfer structure or a linear chamfer structure.

7. The centrifugal fan according to claim 1, wherein the axial height of each of the paraxial sides of said blades is relatively smaller than that of the non-paraxial side.

8. The centrifugal fan according to claim 1, wherein each of said blades of said impeller has a protrusion on lee sides of said blades of said impeller, said protrusion is protruded out of the lee side of the connecting portion, and said protrusion extends toward a center of said hub for dissipating heat.

9. The centrifugal fan according to claim 1, further comprising:

at least one intensification ring connected to outer edges of said blades.

10. A centrifugal fan, comprising:

a hub;

an impeller comprising a plurality of blades, without directly contacting the hub, wherein each of said blades has a chamfer structure at an inlet side of the impeller; and a connecting portion outwardly and radially extending from the outer circumference of said hub, wherein a part of said blades are fixed to said connecting portion in order to be fixed to said hub, each of said blades of said impeller has a protrusion on lee sides of said blades of said impeller, said protrusion is protruded out of the lee side of the connecting portion, said protrusion extends toward a center of said hub for dissipating heat, and the chamfer structure is located apart from the connection portion at an axial height.

11. The centrifugal fan according to claim 10, wherein a radial width of each of said blades at the inlet side of the impeller is relatively smaller than that at the lee side of the impeller.

12. The centrifugal fan according to claim 10, wherein said chamfer structure of each of said blades is a curved chamfer structure or a linear chamfer structure.

13. The centrifugal fan according to claim 10, further comprising:

at least one intensification ring connected to outer edges of said blades.

14. The centrifugal fan according to claim 10, wherein each of the blades have a non-paraxial side and a paraxial side mounted around the outer circumference of said hub, the paraxial sides of said blades are formed to have backward leaning structures, and the non-paraxial sides of said blades are formed to have forward leaning structures.

15. The centrifugal fan according to claim 14, wherein a radial width of each of said blades at the inlet side of the impeller is relatively smaller than that at the lee side of the impeller, and the axial height of each of the paraxial sides of said blades is relatively smaller than that of the non-paraxial side.

16. The centrifugal fan according to claim 10, further comprising:

an anti-decompression cap having a ring-shaped structure connected to the inlet side of said impeller.

17. The centrifugal fan according to claim 16, wherein said anti-decompression cap has an inner diameter greater than or equal to a diameter at the inlet side of said impeller.

* * * * *